US009618004B2

(12) United States Patent
Kim et al.

(10) Patent No.: US 9,618,004 B2
(45) Date of Patent: Apr. 11, 2017

(54) APPARATUS AND METHOD FOR USING A MICROCOMPUTER AND SWITCHES TO CONTROL THE FLOW PATH FOR THE POWER OF A COMPRESSOR BASED UPON THE COMPRESSOR'S LOAD STATE

(71) Applicant: LG Electronics Inc., Seoul (KR)

(72) Inventors: Gyunam Kim, Seoul (KR); Sungho Park, Seoul (KR); Taewoong Nah, Seoul (KR); Jaeyoo Yoo, Seoul (KR); Boram Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 445 days.

(21) Appl. No.: 13/748,813

(22) Filed: Jan. 24, 2013

(65) Prior Publication Data

US 2013/0189075 A1 Jul. 25, 2013

(30) Foreign Application Priority Data

Jan. 25, 2012 (KR) ..... 10-2012-0007509
Nov. 19, 2012 (KR) ..... 10-2012-0131156

(51) Int. Cl.
*F04D 27/00* (2006.01)
*F04B 35/04* (2006.01)
*F04D 27/02* (2006.01)

(52) U.S. Cl.
CPC ..... *F04D 27/00* (2013.01); *F04B 35/045* (2013.01); *F04D 27/02* (2013.01)

(58) Field of Classification Search
CPC ..... F04D 27/00; F04D 27/02; F04B 35/045; H02M 2001/0048; H02M 2007/4803
USPC ..... 417/17, 45, 18–20, 43, 44.1, 44.2, 44.11
See application file for complete search history.

(56) References Cited

U.S. PATENT DOCUMENTS 7,114,366 B1 * 10/2006 Jones ..... G01P 15/125 73/1.01
2002/0190698 A1 * 12/2002 Smidt ..... H02M 3/33584 323/222
2008/0292475 A1 * 11/2008 Kim ..... F04B 35/045 417/45
2010/0028727 A1 * 2/2010 Hortop ..... B60K 6/32 429/431

* cited by examiner

*Primary Examiner* — William H Rodriguez
*Assistant Examiner* — Christopher Brunjes
(74) *Attorney, Agent, or Firm* — KED & Associates, LLP

(57) ABSTRACT

A compressor control apparatus, and a compressor control method. The compressor may be operated in an operation mode in which commercial power applied to the compressor does not pass through an alternating current capacitor when the load is in an overload state, thereby preventing the loss of a drive and effectively reducing the copper and core loss of the compressor.

17 Claims, 13 Drawing Sheets

APPARATUS AND METHOD FOR USING A MICROCOMPUTER AND SWITCHES TO CONTROL THE FLOW PATH FOR THE POWER OF A COMPRESSOR BASED UPON THE COMPRESSOR'S LOAD STATE

CROSS-REFERENCE TO RELATED APPLICATION(S)

This application claims priority to Korean Application Nos. 10-2012-0007509 filed on Jan. 25, 2012, and 10-2012-0131156 filed on Nov. 19, 2012, which are herein expressly incorporated by reference in their entirety.

BACKGROUND

1. Field

This relates to an apparatus and method for controlling a compressor.

2. Background

In a reciprocating compressor, a piston performs a linear reciprocating movement within a cylinder to suction, compress and discharge refrigerant gas. Reciprocating compressors may be classified as recipro compressors and linear compressors based on how the piston is driven.

In a recipro compressor, a crank shaft is coupled to a rotating motor and a piston is coupled to the crank shaft, thereby converting a rotational movement of the rotary motor into a linear reciprocating movement. In a linear compressor, a piston is directly connected to a mover of a linear motor, thereby converting a linear movement of the motor into a reciprocating movement of the piston. The linear motor does not have a crank and thus frictional losses may be relatively small.

BRIEF DESCRIPTION OF THE DRAWINGS

The embodiments will be described in detail with reference to the following drawings in which like reference numerals refer to like elements wherein.

DETAILED DESCRIPTION

Linear compressors may be used in various different types of appliances, such as, for example, a refrigerator, an air conditioner, and the like, to vary a voltage applied to the compressor and the freezing capacity. An alternating current (AC) capacitor may be connected in series to the compressor to enhance the usage rate of voltage applied to the compressor. However, when the AC capacitor is connected to the compressor, core losses may increase.

A compressor control apparatus as embodied and broadly described herein may include a commercial power source configured to supply power to a compressor, an alternating current (AC) capacitor connected in series to the compressor, a microcomputer configured to generate a control signal for selectively performing a first mode operation to allow power applied to the compressor to pass through the alternating current capacitor, and a second mode operation to allow the power to pass through a branched circuit, based on the state of the load, and a switch unit configured to control the commercial power source applied to the alternating current capacitor based on the control signal. A compressor control apparatus as embodied and broadly described herein may be implemented such that an alternating current capacitor is selectively used to apply a suitable size of voltage to the compressor motor based on the state of the load, thereby enhancing the drive efficiency of the compressor, and preventing the loss of a drive and effectively reducing the copper and core loss of the compressor.

Hereinafter, a compressor control apparatus and a control method thereof according to an embodiment as broadly described herein will be described in detail with reference to the accompanying drawings.

Figure 1:
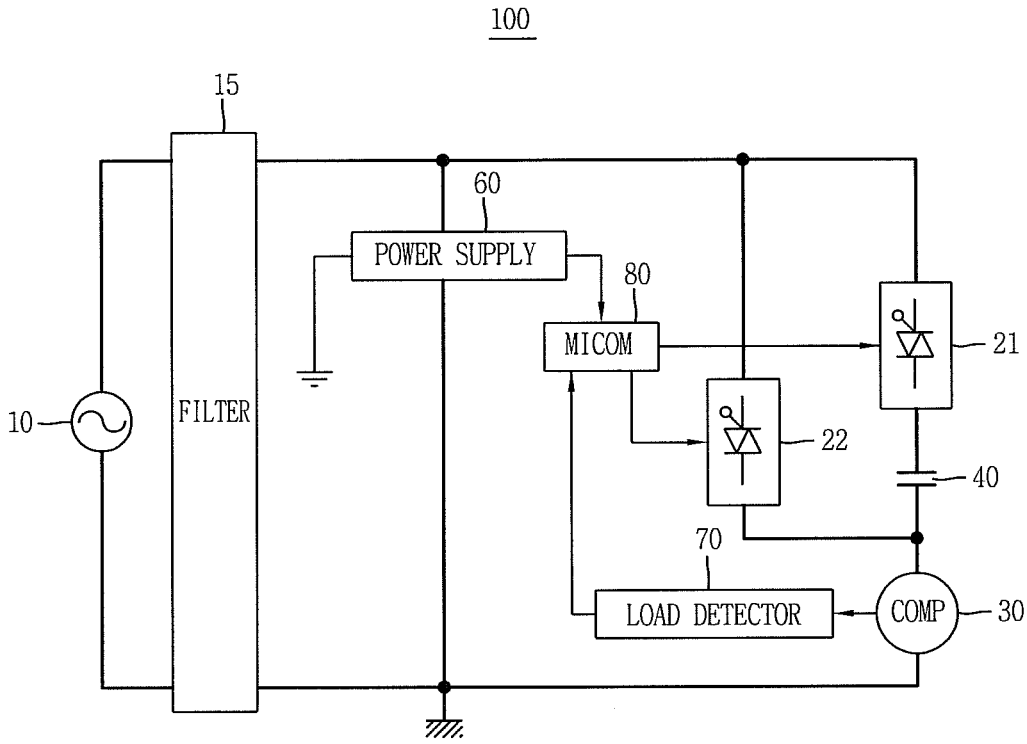
FIGS. 1 and 2 are circuit block diagrams of a compressor control apparatus according to an embodiment as broadly described herein.
Figure 2:
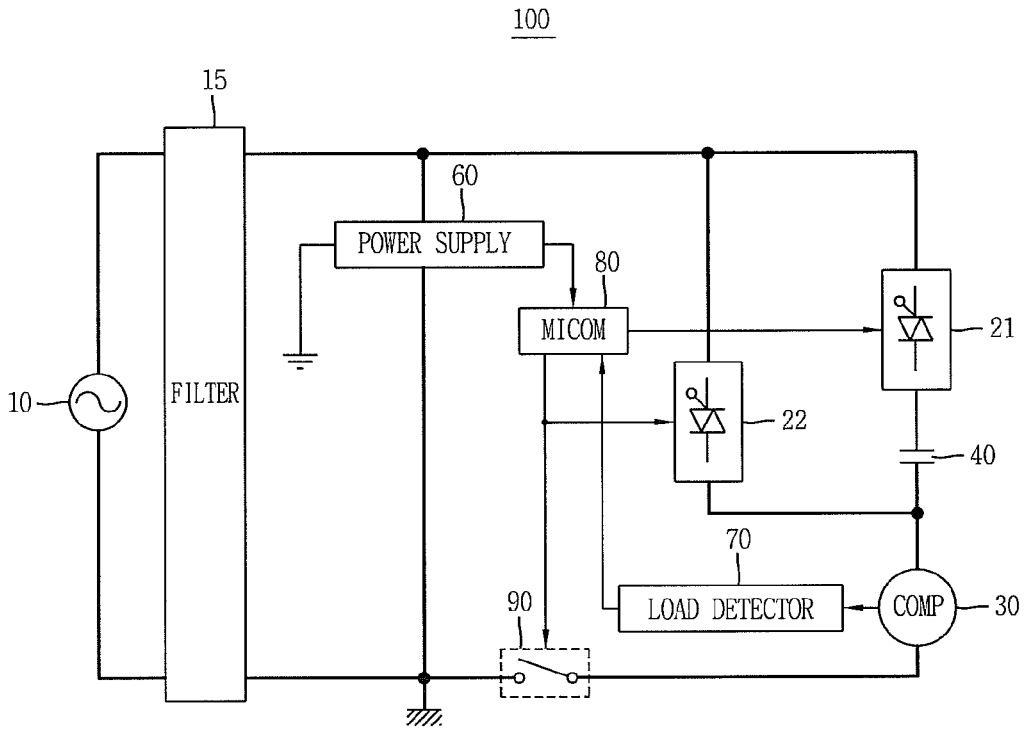

First, referring to FIGS. 1 and 2, a compressor control apparatus 100 according to an embodiment may include a commercial power source 10 configured to supply power to a compressor, an alternating current (AC) capacitor 40 connected in series to the compressor 30, two or more alternating current switches 21, 22, with at least one alternating current switch including a switch device 20 (see FIG. 9) connected in series to an alternating current capacitor 40, and a microcomputer 80 configured to generate the control signal for selectively performing a first mode to allow power applied to the compressor to pass through the alternating current capacitor, and a second mode to allow the power to pass through a branched circuit, based on the state of the load.

The commercial power source 10 supplies power to the compressor 30. Then, the compressor 30 receives the power to perform a reciprocating movement of the piston. The commercial power source 10 may be an alternating current power source such as 220 V or the like. A filter 15 may remove harmonics, noises or the like from the commercial power source 10.

A configuration of the compressor 30, for example, a linear compressor, to which a control apparatus and a control method as embodied and broadly described herein may be applied, will be described in brief. However, according to the configuration of the following linear compressor, part of the constituent elements may be changed or removed or other constituent elements may be added thereto as required.

Figure 13:
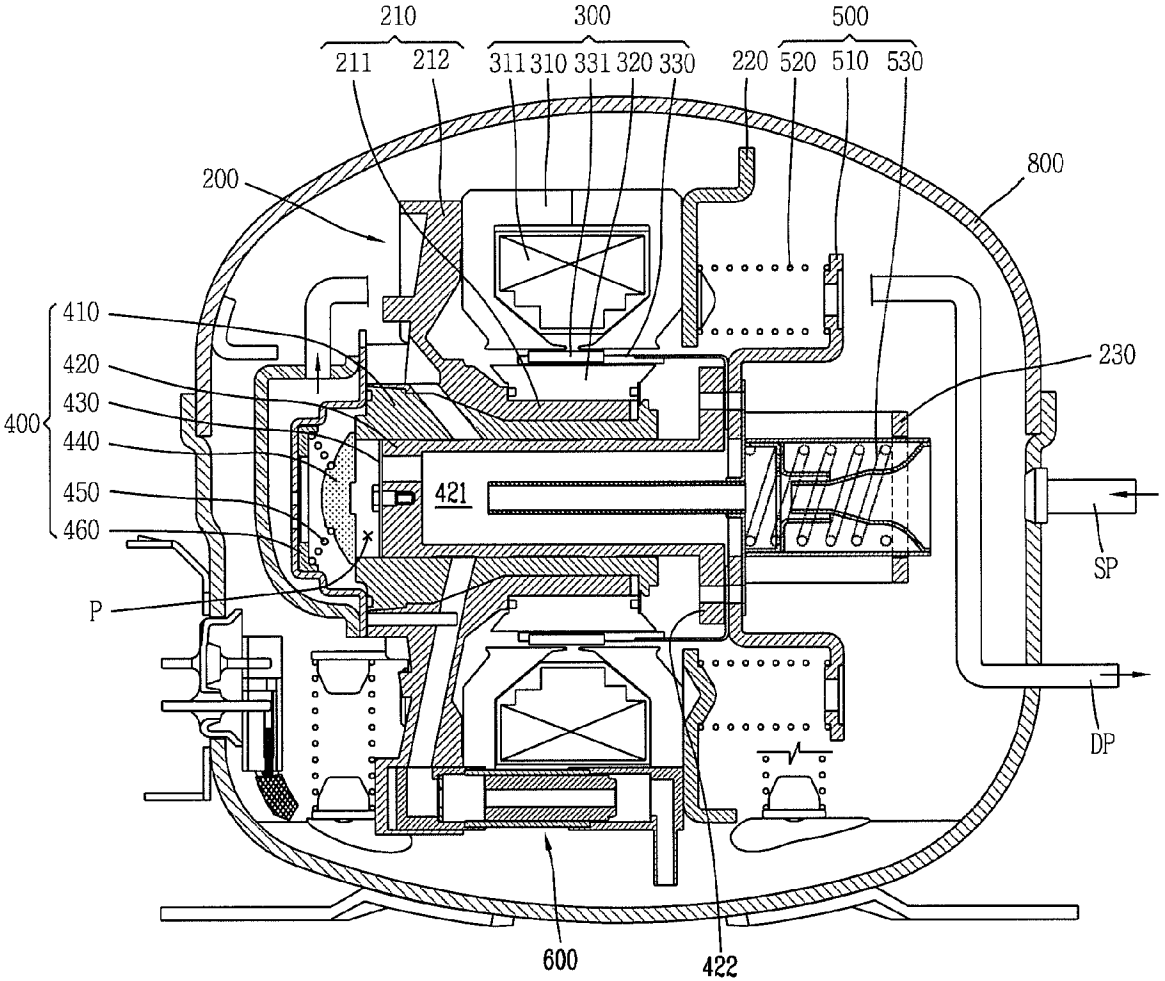
FIG. 13 is a cross-sectional view of a reciprocating compressor including a compressor control apparatus according to embodiments as broadly described herein.

A reciprocating compressor will be described in more detail with reference to FIG. 13. The reciprocating compressor may include a casing 800 communicated with a gas suction pipe (SP) and a gas discharge pipe (DP), a frame assembly 200 elastically supported by an inner portion of the casing 800, a motor 300 supported by the frame assembly 200 to allow a mover 330 to perform a linear reciprocating movement, a compression unit 400 in which a piston 420 is coupled to the mover 330 of the motor 300 and supported by the frame assembly 200, a plurality of resonant units 500 for elastically supporting the mover 330 of the motor 300 and the piston 420 of the compression unit 400 in the movement direction to induce a resonant movement.

The frame assembly 200 may include a first frame 210 supporting the compression unit 400 and a front side of the motor 300, a second frame 220 coupled to the first frame 210 to support a rear side of the motor 300, and a third frame 230 coupled to the second frame 220 to support a plurality of resonant springs 530. The first frame 210, second frame 220, and third frame 230 may be all formed of a non-magnetic material, such as aluminum, to reduce core losses.

The first frame 210 may include with a frame portion 211 having an annular plate shape, a cylinder portion 212 having a cylindrical shape into which a cylinder 410 is inserted, formed on a rear surface, namely, lengthwise as an integral body in the motor direction, at a center of the frame portion 211. The frame portion 211 may be formed such that the outer diameter of the frame portion 211 is at least not less than the inner diameter of the outer stator 310 of the motor 300 to support both an outer stator 310 and an inner stator 320.

The first frame 210 may be fixed such that the inner stator 320 is inserted into an outer circumferential surface of the cylinder portion 212. In this case, the first frame 210 may be formed of a non-magnetic material, such as aluminum, to reduce magnetic losses. The cylinder portion 212 may be formed on the cylinder 410 as an integral body using an insert die casting method. However, the cylinder portion 212 may be screw-assembled such that the cylinder 410 is pressurized or a screw thread is formed at an inner circumferential surface thereof. A step surface or inclined surface may be formed between a front side inner circumferential surface and a rear side inner circumferential surface of the cylinder portion 212, thereby allowing the cylinder 410 coupled to an inner circumferential surface of the cylinder portion 212 to be supported in the piston direction, to improve stability of the cylinder 410.

The motor 300 may include an outer stator 310 supported between the first frame 210 and second frame 220 and around which a coil 311 is wound, an inner stator 320 coupled to an inner side of the outer stator 310 with a predetermined interval and inserted into the cylinder portion 212, and a mover 330 in which a magnet 331 is provided to correspond to the coil 311 of the outer stator 310 to perform a linear reciprocating movement along the magnetic flux direction between the outer stator 310 and inner stator 320. The outer stator 310 and inner stator 320 may be formed by laminating a plurality of thin stator core sheets in a cylindrical shape for each sheet or laminating a plurality of thin stator core sheets in a block shape and laminating the stator block in a radial shape.

The compression unit 400 may include a cylinder 410 formed on the first frame 210 as an integral body, a piston 420 coupled to the mover 330 of the motor 300 to perform a reciprocating movement in the compression space (P) of the cylinder 410, a suction valve 430 mounted at a front end of the piston 420 to control the suction of the refrigerant gas while opening or closing the suction passage 421 of the piston 420, a discharge valve 440 mounted at a discharge side of the cylinder 410 to control the suction of the compression gas while opening or closing the compression space (P) of the cylinder 410, a valve spring 450 elastically supporting the discharge valve 440, and a discharge cover 460 fixed to the first frame 210 at a discharge side of the cylinder 410 to accommodate the discharge valve 440 and valve spring 450.

The cylinder 410 may be formed in a cylindrical shape and inserted into and coupled to the cylinder portion 212 of the first frame 210. The cylinder 410 may be formed of a material having a hardness higher than that of cast iron or at least that of the first frame 210, more accurately, that of the cylinder portion 212 by considering abrasion due to the piston 420 as forming a bearing surface with the piston 420 an inner circumferential surface of which is made of cast iron. The piston 420 may be formed of the same material as the cylinder 410, or may be formed of a material having a hardness similar to that of the cylinder 410 to reduce abrasion with the cylinder 410. Furthermore, the suction passage 421 may penetrate into the piston 420 such that refrigerant is suctioned into the compression chamber (P) of the cylinder 410.

The resonant unit 500 may include a spring supporter 510 coupled to a connecting portion between the mover 330 and the piston 420, first resonant springs 520 supported at a front side of the spring supporter 510, and second resonant springs 530 supported at a rear side of the spring supporter 510.

The compressor may also include a piston connecting portion 422 and an oil feeder 600.

When power is applied to the motor 300 and a magnetic flux is formed between the outer stator 310 and inner stator 320, the mover 330 placed at a gap between the outer stator 310 and inner stator 320 continuously performs a reciprocating movement by the resonant unit 500 while moving along the direction of the magnetic flux. When the piston 420 performs a backward movement within the cylinder 410, refrigerant filled in an inner space of the casing 800 passes through the suction passage 421 of the piston 420 and the suction valve 430 and drawn into the compression space (P) of the cylinder 410. When the piston 420 performs a forward movement within the cylinder 410, refrigerant gas drawn into the compression space (P) is compressed to repeat a series of processes of discharging while opening the discharge valve 440.

Figure 14:
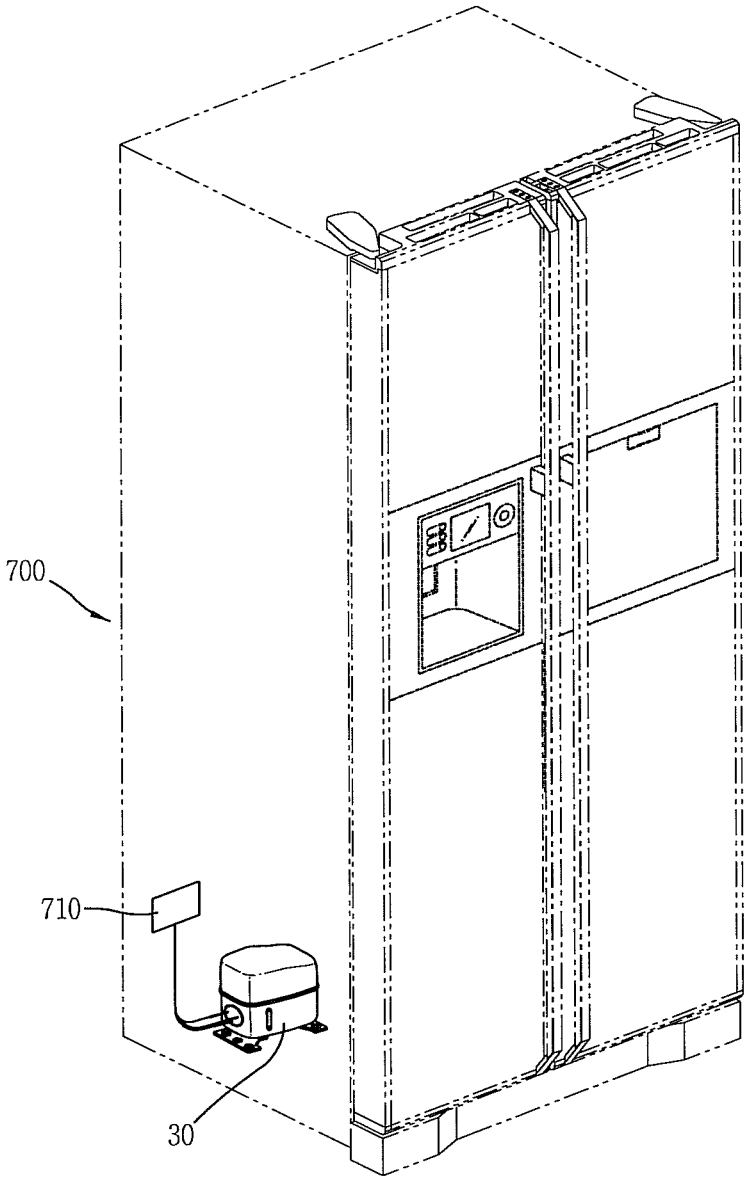
FIG. 14 is a perspective view of an exemplary refrigerator to which the reciprocating compressor shown in FIG. 13 may be applied.

A reciprocating compressor according to embodiments as broadly described herein may include a compressor control apparatus as follows. Furthermore, the reciprocating compressor may be used for a freezing device such as a refrigerator or air conditioner. For example, referring to FIG. 14, a freezing device 700 having a refrigerant compression type freezing cycle including a compressor, a condenser, an expansion apparatus and an evaporator may include a main board 710 for controlling overall operation of the freezing device, and connected to the reciprocating compressor (C). The compressor control apparatus may be provided in the main board 710.

Referring to FIGS. 1 and 2 again, the alternating current capacitor 40 is connected in series to the compressor 30 to provide an additional voltage to the compressor 30 during an overload. The alternating current capacitor 40 may be connected in series to at least one alternating current switch 21, and also the alternating current capacitor 40 may be formed to have a capacitance corresponding to the inductance of a coil wound around a motor of the compressor 30.

The switch device 20 as embodied and broadly described herein may be connected in series or parallel to the alternating current capacitor 40. The switch device 20 controls commercial power applied to the alternating current capacitor 40 based on a switching control signal. Accordingly, the switch device 20 is operated to selectively use the alternating current capacitor 40 in correspondence to the control signal of the microcomputer 80.

The microcomputer 80 generates a control signal for determining the flow of the power applied to the compressor 30 based on the state of the load. More specifically, the microcomputer 80 generates a control signal performing a first mode for allowing power to pass through the alternating current capacitor 40 based on the state of the load. When the load is in an overload state, the microcomputer 80 generates a control signal performing the first mode, and operates the alternating current switch 21 connected in series to the alternating current capacitor 40.

The microcomputer 80 also performs a second mode to allow power applied to the compressor 30 to pass through a branched circuit based on the state of the load. In other words, when the load is in a medium load state or low load state, the microcomputer 80 generates a control signal performing the second mode, and operates the alternating current switch 22 that is not connected to the alternating current capacitor 40.

A criterion for selecting the operation of the first mode or second mode carried out by the microcomputer 80 depends on the state of the load. To this end, the compressor control apparatus may further include a predetermined means for detecting the state of the load. For example, the state of the load may be calculated using a current amount flowing through the motor of the compressor 30. On the other hand, when the compressor 30 is applied to a freezing cycle, the state of the load may be calculated based on a predetermined value of a temperature sensor or the like.

Figure 3:
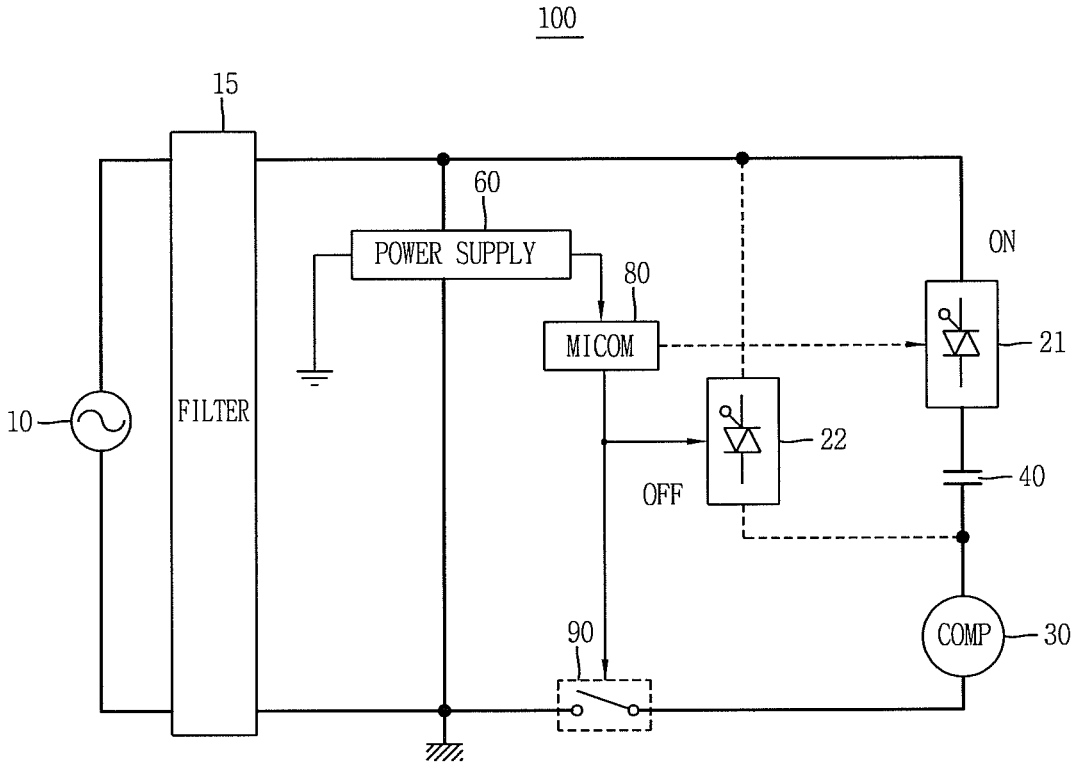
FIGS. 3 and 4 are a circuit diagram and a graph of an operation in which a reciprocating compressor uses an alternating current capacitor, in accordance with embodiments as broadly described herein.
Figure 4:
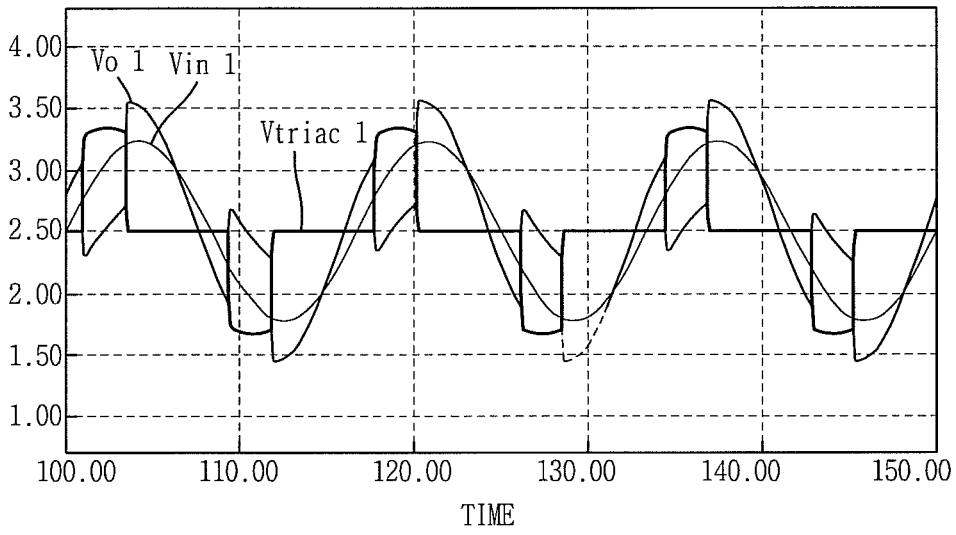

The microcomputer 80 may generate a control signal to operate the compressor in the first mode when the load is in an overload state. In this instance, the load applied to the compressor 30 may become an overload state when the compressor 30 is applied to a freezing cycle, or the freezing cycle is initially started, or ambient temperature is high, or a high temperature object is suddenly cooled, or the like. Then, the alternating current switch 21 connected in series to the alternating current capacitor 40 is operated. In other words, when the detected load is in an overload state, the microcomputer 80 turns off the second alternating current switch 22 as illustrated in FIG. 3, and connects the commercial power source 10 to the compressor 30 through the first alternating current switch 21 and alternating current capacitor 40. Furthermore, the microcomputer 80 may generate and transfer a control signal for driving the first alternating current switch 21, for example, a triac, to perform the speed control, stroke control or the like of the compressor 30. The input voltage (Vin1), output voltage (Vo1), and alternating current switch voltage (Vtriac1) during an overload state, namely, in the first mode, are illustrated in FIG. 4.

Figure 5:
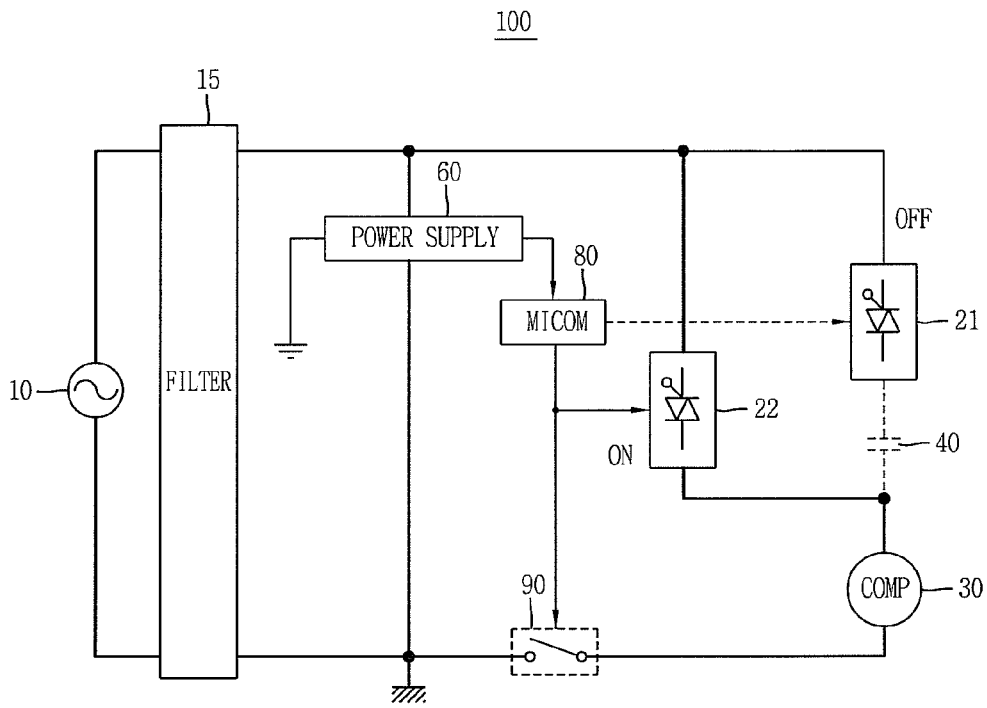
FIGS. 5 and 6 are a circuit diagram and a graph of an operation in which a reciprocating compressor does not use an alternating current capacitor.
Figure 6:
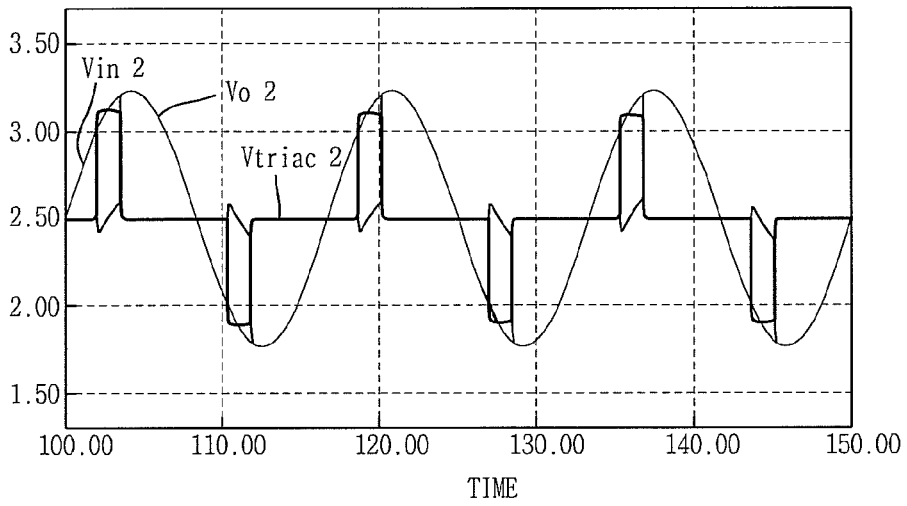

The microcomputer 80 may also generate a control signal for operating the compressor in the second mode when the load is in a medium load state or a low load state. Then, the switch device 20 is operated so that the commercial power 10 is not allowed to pass through the alternating current capacitor 40 based on the control signal. In other words, the alternating current switch 22 that is not connected to the alternating current capacitor 40 is operated. As illustrated in FIG. 5, the microcomputer 80 turns off the first alternating current switch 21 connected in series to the alternating current capacitor 40, and turns on the second alternating current switch 22 such that the commercial power 10 is applied to the compressor through the second alternating current switch 22. Furthermore, the microcomputer 80 may generate and transfer a control signal for driving the second alternating current switch 22, for example, a triac, to perform the speed control, stroke control or the like of the compressor 30. The input voltage (Vin1), output voltage (Vo1), and alternating current switch voltage (Vtriac1) during a medium load state or low load state, namely, in the second mode, are illustrated in FIG. 6.

In this manner, when the load is in a medium load state or low load state, a second mode is carried out in which the alternating current capacitor 40 is not used, and thus the alternating current capacitor 40 is not used during a typical operation when the compressor control apparatus is not in an overload state, thereby enhancing energy efficiency while reducing a current required to generate the same stroke.

Figure 7:
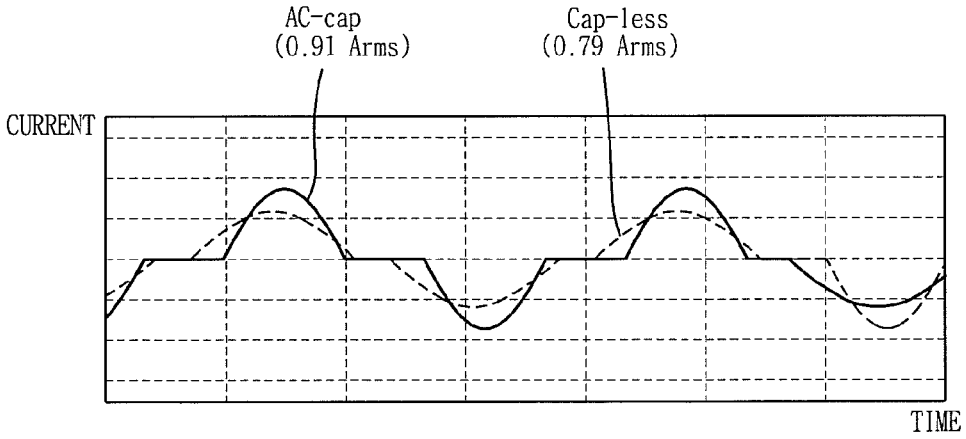
FIG. 7 is a graph comparing current waveforms based on whether or not an alternating current capacitor is used in a compressor control apparatus as embodied and broadly described herein.

In FIG. 7, current waveforms are compared with each other in a case in which the compressor 30 is driven using the alternating current capacitor 40, and a case in which the compressor 30 is driven without using the alternating current capacitor 40. As shown in FIG. 7, when power that has passed through the alternating current capacitor 40 is applied to the compressor 30, a current value for generating the stroke is about 0.91 A. On the other hand, when commercial power is applied to the compressor 30 without using the alternating current capacitor 40, a current value for generating the same stroke is about 0.79 A. In other words, when the alternating current capacitor 40 is not used, the current waveform is closer to a sine wave, and thus the drive loss is enhanced by about 0.1 W, thereby obtaining an effect that copper loss of the motor of the compressor 30 may be improved by about 20%.

Figure 8:
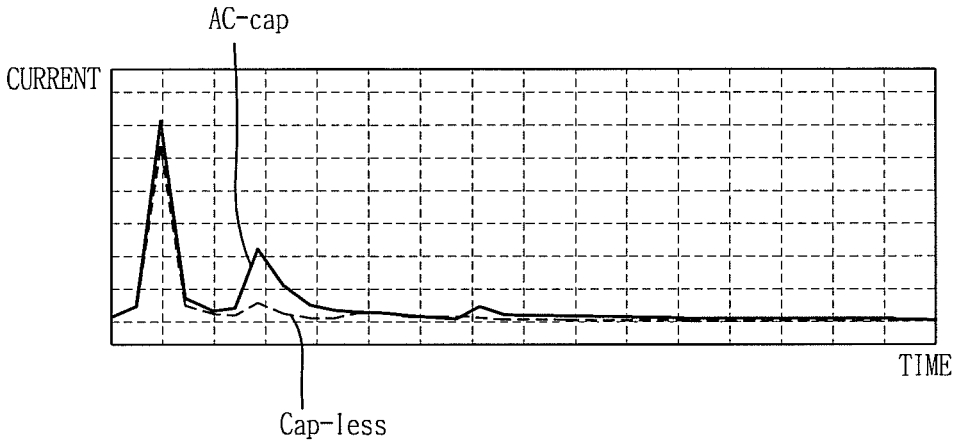
FIG. 8 is a graph in which current values are Fourier-transformed and compared with each other based on whether or not an alternating current capacitor is used in a compressor control apparatus.

FIG. 8 is a graph in which current values are Fourier-transformed and compared with each other based on whether or not the alternating current capacitor 40 is used. As shown in FIG. 8, in both cases, the compressor control apparatus 100 has a similar peak value at the first harmonic. However, the peak value is about 0.43 A at the third harmonic in a case in which the alternating current capacitor 40 is used, whereas the peak value is about 0.11 A at the third harmonic in a case in which the alternating current capacitor 40 is not used. In other words, the third harmonic component for generating the stroke in the case in which the alternating current capacitor 40 is not used is reduced by about 70% compared to the case in which the alternating current capacitor 40 is used, thereby obtaining an effect that the core loss of the motor of the compressor 30 may be reduced by greater than about 70%.

Figure 9:
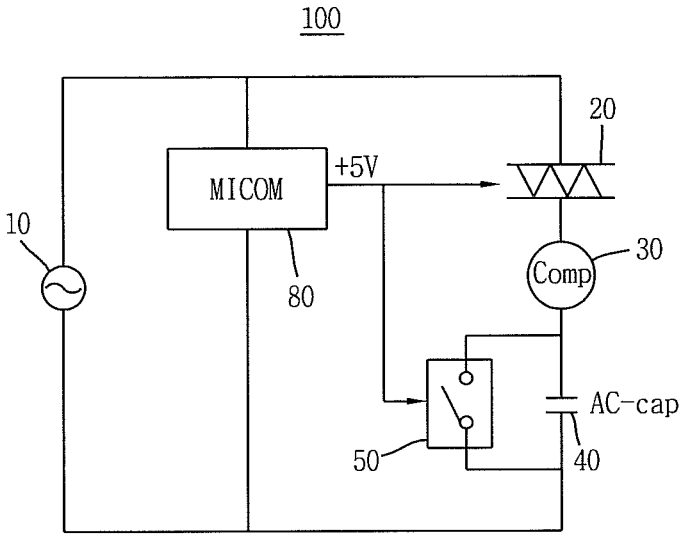
FIGS. 9 and 10 are circuit block diagrams of a compressor control apparatus according to another embodiment as broadly described herein.
Figure 10:
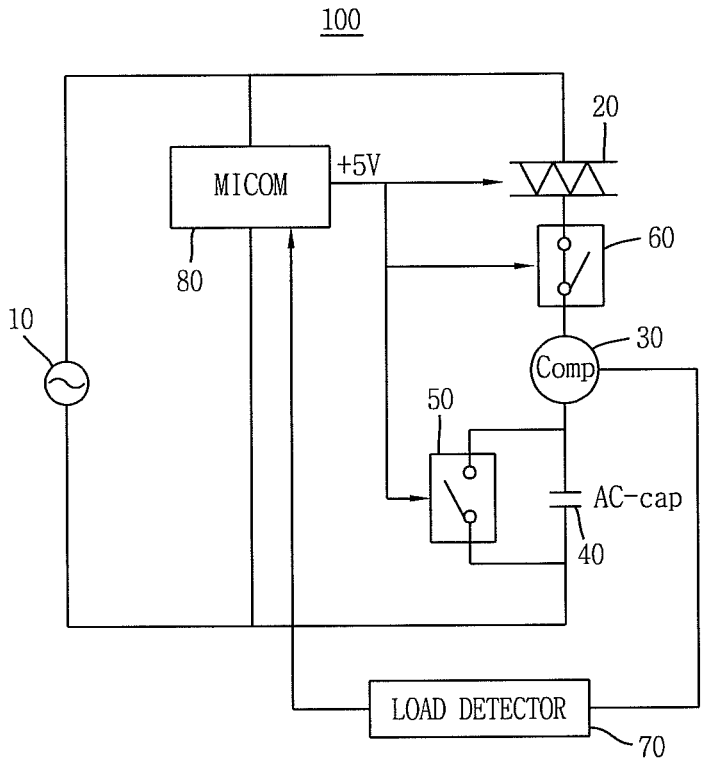

Referring to FIGS. 9 and 10, a compressor control apparatus 100 in accordance with another embodiment as broadly described herein may include a commercial power source 10, a compressor 30, a microcomputer 80, an alternating current capacitor 40, and a switch device 50. The compressor control apparatus 100 may also include a triac 20 connected in series to the compressor 30 and a triac protection relay 60 connected in series to the triac 20. The configuration may vary as appropriate for a particular application.

The description of a compressor control apparatus according to the present embodiment will be omitted wherever possible where it duplicates the foregoing embodiment.

The switch device 50 of this embodiment is connected in parallel to the alternating current capacitor 40, and may control commercial power applied to the alternating current capacitor 40 based on a switching control signal. In other words, the switch device 50 is operated to selectively use the alternating current capacitor 40 in correspondence to the control signal of the microcomputer 80.

The microcomputer 80 generates a control signal for determining the flow of power applied to the compressor 30 based on the state of the load. More specifically, the microcomputer 80 generates a control signal performing a first mode for allowing power to pass through the alternating current capacitor 40 or a second mode for allowing power applied to the compressor 30 to pass through a branched circuit based on the state of the load.

More specifically, when the load is in an overload state, the microcomputer 80 generates a control signal to operate in the first mode. In other words, when the detected load is in an overload state, the microcomputer 80 generates a control signal for turning off the switching element of the switch device 50, thereby connecting the commercial power source 10 to the compressor 30 through the alternating current capacitor 40. Furthermore, the microcomputer 80 may generate and transfer a control signal for driving the triac 20 to perform speed control, frequency control, stroke control or the like of the compressor 30.

On the contrary, when the load is in a medium load state or low load state, the microcomputer 80 generates a control signal to operate in the second mode. Then, the switch device 50 operates a switching element so that commercial power 10 is not allowed to pass through the alternating current capacitor 40, namely, allowing the power to pass through another branched circuit based on the control signal. In other words, when the detected load is in a medium load state or low load state, the microcomputer 80 generates a control signal for turning on the switching element of the switch device 50, thereby allowing the commercial power 10 to be directly applied to the compressor 30 without passing through the alternating current capacitor 40. Furthermore, the microcomputer 80 may generate and transfer a control signal for driving the triac 20 to perform speed control, frequency control, stroke control or the like of the compressor 30.

On the other hand, the initial state of a switching element in the switch unit 50 may be set to an ON state. In other words, when the preset position of a switching element in the switch device 50 is initially set so that it does not pass through the alternating current capacitor 40, the switch device 50 does not perform any operation in a medium load state or low load state. Furthermore, in the same circumstance, the microcomputer 80 does not generate any signal, and thus the contact points of the switching elements in the switch device 50 may continuously maintain an ON state.

A compressor control apparatus in accordance with the embodiment shown in FIGS. 9 and 10 may further include a triac 20 connected in series to the compressor 30 to operate the compressor 30 based on the gate drive control signal, and the triac 20 may be further provided with a triac protection relay 60 for triac protection during abnormal operation of a drive. The gate drive control signal is generated and provided from the microcomputer 80. The compressor control apparatus may also include a load detector 70 for detecting the state of the load as illustrated in FIGS. 1, 2, 9 and 10. The load detector 70 provides the detected state of the load to the microcomputer 80. The microcomputer 80 may include an overload determination device, either provided therein or connected thereto. Accordingly, the microcomputer 80 compares a predetermined reference value with the state value of the load detected by the load detector 70, and determines whether the detected load is in an overload state as a result of the comparison.

A compressor control apparatus as embodied and broadly described herein may also include a rectifier connected to the commercial power source 10 to rectify the commercial power, and, in this case, to supply rectified power to the compressor 30, and a protection relay 90 for blocking a circuit as appropriate, as illustrated in FIG. 2.

In general, connecting the commercial power source 10 directly to the compressor 30 without using the alternating current capacitor 40 may improve the copper loss and iron loss of the motor of the compressor 30, but the use of the alternating current capacitor 40 may enhance the drive efficiency of the compressor 30 in an overload state (refer to FIGS. 7 and 8), and thus the compressor control apparatus 100 as embodied and broadly described herein may selectively use the alternating current capacitor 40 based on the state of the load.

Figure 11:
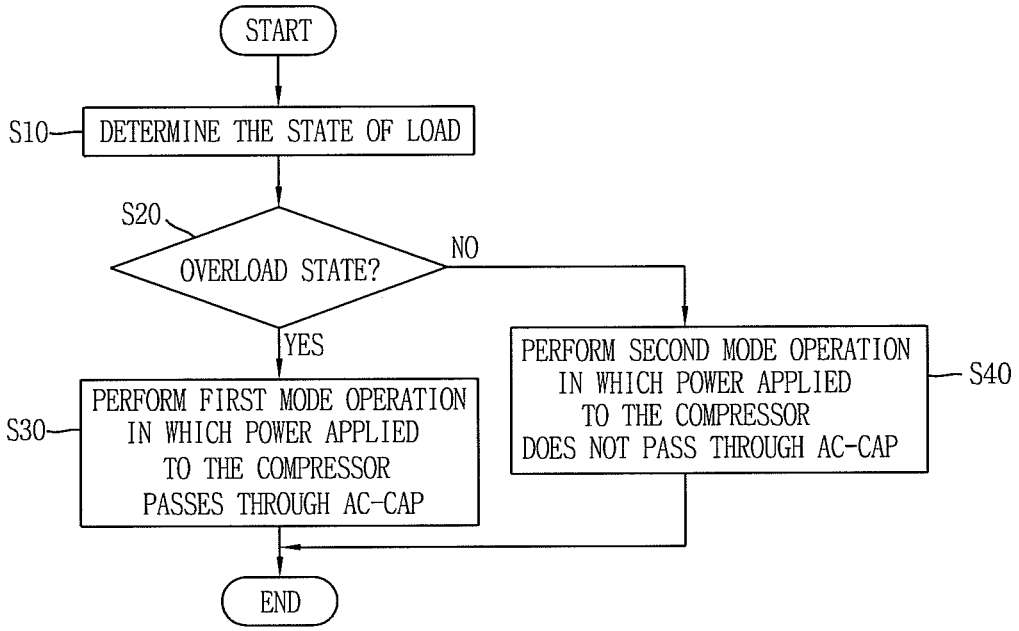
FIG. 11 is a flow chart of a method of controlling a compressor control apparatus according to an embodiment as broadly described herein.
Figure 12:
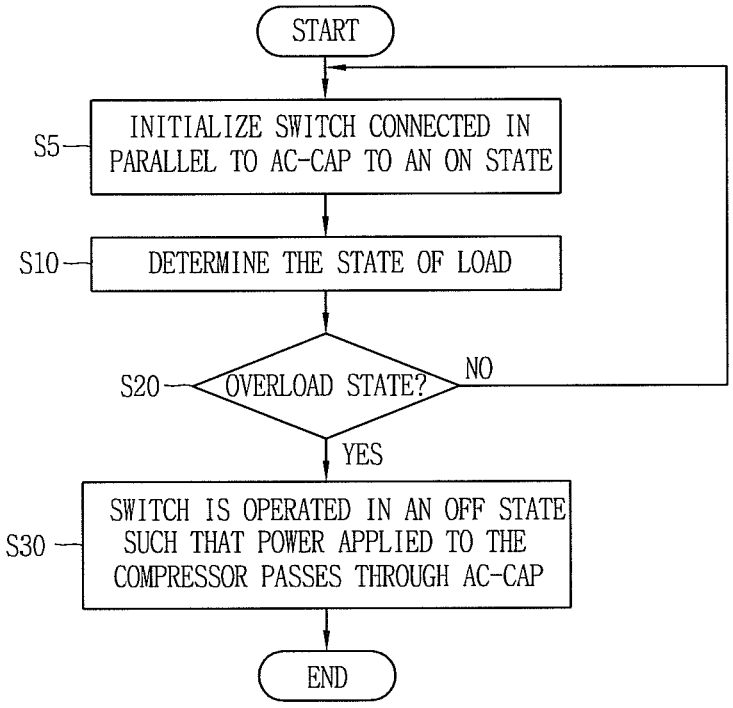
FIG. 12 is a flow chart of a method of controlling a compressor control apparatus according to another embodiment as broadly described herein.

As shown in FIG. 11, the compressor control apparatus first determines the state of the load applied to the compressor (S10). As a result of the determination (S20), when the state of the load is in an overload state, a first mode operation allowing power applied to the compressor to pass through the alternating current capacitor (AC-cap) is carried out (S30). As an example, when the detected load is in an overload state, the compressor control apparatus turns off the second alternating current switch and connects the commercial power source to the compressor through the first alternating current switch and alternating current capacitor as illustrated in FIG. 3. Then, the compressor control apparatus may generate and transfer a control signal for driving the first alternating current switch, for example, a triac, to perform the speed control, stroke control or the like of the compressor. The input voltage (Vin1), output voltage (Vo1), and alternating current switch voltage (Vtriac1) during an overload state, namely, in the first mode, are illustrated in FIG. 4. As another example, as illustrated in FIGS. 9 and 10, the compressor control apparatus may generate a control signal for turning off the switching element of the switch device 50, thereby connecting the commercial power source 10 to the compressor 30 through the alternating current capacitor.

On the other hand, as a result of the determination (S20), when the state of the load is in a medium load state or low load state, a second mode operation, which does not allow power applied to the compressor to pass through the alternating current capacitor (AC-cap), is carried out (S40). As an example, the compressor control apparatus turns off the first alternating current switch connected in series to the alternating current capacitor, and turns on the second alternating current switch, thereby applying commercial power to the compressor through the second alternating current switch as illustrated in FIG. 5. Furthermore, the microcomputer may generate and transfer a control signal for driving the second alternating current switch, for example, a triac, to perform the speed control, stroke control or the like of the compressor. The input voltage (Vin1), output voltage (Vo1), and alternating current switch voltage (Vtriac1) during a medium load state or low load state, namely, in the second mode, are illustrated in FIG. 6. As another example, as illustrated in FIGS. 9 and 10, the compressor control apparatus may generate a control signal for turning on the switching element of the switch device 50, thereby connecting the commercial power source 10 directly to the compressor 30.

In this manner, power applied to the compressor may not be allowed to pass through the alternating current capacitor (AC-cap) at normal times, but may be allowed to pass through the alternating current capacitor (AC-cap) in an overload state, thereby enhancing drive efficiency as well as supplying additional voltage in an overload state.

On the other hand, as illustrated in FIGS. 9 and 10, when the alternating current capacitor 40 is connected in parallel to the switch device 50, said selecting a first mode or second mode based on the state of the load may include receiving a switching control signal for operating a switch device connected in parallel to the alternating current capacitor. Furthermore, said selecting step may further include performing the on/off operation of the switch device based on the received control signal to perform the first mode or the second mode. In other words, whether or not to use the alternating current capacitor (AC-cap) provided therein may be implemented such that the selection of a plurality of operation modes is carried out using software or through a hardware means such as a switch, for instance.

In a compressor control apparatus and method as embodied and broadly described herein, an alternating current capacitor may be selectively used to apply a suitable size voltage to the compressor motor based on the state of the load, enhancing drive efficiency of the compressor. Furthermore, according to embodiments as broadly described herein, the compressor may be operated in an operation mode in which commercial power applied to the compressor does not pass through an alternating current capacitor when the load is in an overload state, thereby preventing loss of a drive and reducing copper and core losses of the compressor. Moreover, according to embodiments as broadly described herein, overall power consumption may be reduced due to the loss reduction of a drive, thereby improving energy efficiency and reducing harmonic components for generating the same stroke even when an alternating current (AC) capacitor is provided therein.

A compressor control apparatus and method are provided in which a circuit for which an alternating current capacitor may be used only when needed, thereby enhancing drive efficiency of the compressor.

A compressor control apparatus and method are provided in which a plurality of operation modes may be selectively applied to drive the compressor at a suitable voltage based on the state of the load, thereby enhancing energy efficiency and reducing copper losses and core losses of the compressor.

A compressor control apparatus as embodied and broadly described herein may include a commercial power source configured to supply power to a compressor, an alternating current (AC) capacitor connected in series to the compressor, a microcomputer configured to generate a control signal for selectively performing a first mode operated to allow power applied to the compressor to pass through the alternating current capacitor, and a second mode operated to allow the power to pass through a branched circuit, based on the state of the load, and a switch unit configured to control the commercial power source applied to the alternating current capacitor based on the control signal.

The switch unit may include two or more alternating current switches, and at least one alternating current switch may be connected in series to the alternating current capacitor. In this case, when the load is in an overload state, the microcomputer may generate a control signal performing the first mode, and operate an alternating current switch connected in series to the alternating current capacitor, and when the load is in a medium load state or low load state the microcomputer may generate a control signal performing the second mode, and operate an alternating current switch that is not connected to the alternating current capacitor.

The switch unit may be connected in parallel to the alternating current capacitor. In this case, when the load is in an overload state, the microcomputer may generate a control signal performing the first mode, and the switch unit may operate a switching element provided to allow the power to pass through the alternating current capacitor based on the control signal, and when the load is in a medium load state or low load state, the microcomputer may generate a control signal performing the second mode. At this time, the initial state of a switching element in the switch unit may be an ON state.

In certain embodiments, the compressor control apparatus may further include a triac connected in series to the compressor to operate the compressor based on a gate drive control signal.

In certain embodiments, the compressor control apparatus may further include a load detection means configured to detect the state of the load to provide it to the microcomputer. In this case, the microcomputer may include an overload determination unit configured to determine whether the detected state of the load is an overload.

A In certain embodiments, the compressor control apparatus may further include a rectifier unit configured to rectify the commercial power.

A compressor control apparatus as embodied and broadly described herein may include an alternating current (AC) capacitor connected in series to a compressor, and a microcomputer configured to control to selectively perform a first mode operated to allow power applied to the compressor to pass through the alternating current capacitor, and a second mode operated not to allow the power to pass through the alternating current capacitor, based on the state of the load. In this case, the compressor control apparatus may further include a switch unit including two or more alternating current switches in which at least one alternating current switch is connected in series to the alternating current capacitor.

A compressor control apparatus as embodied and broadly described herein may include an alternating current (AC) capacitor connected in series to a compressor, and a microcomputer configured to control to selectively perform a first mode operated to allow commercial power applied to the compressor to pass through the alternating current capacitor, and a second mode operated to allow the power to pass through a branched circuit, based on the state of the load. In this case, the microcomputer may control to perform a first mode when the load is in an overload state, and perform a second mode when the load is in a medium load state or low load state.

A compressor control method including a compressor and an alternating current capacitor connected in series to the compressor, as embodied and broadly described herein, may include determining the state of the load, and selecting either one of a first mode operated to allow power applied to the compressor to pass through the alternating current capacitor, and a second mode operated to allow the power to pass through a branched circuit, based on the state of the load. In this case, said selecting step may select the first mode when the load is in an overload state, and select the second mode when the load is in a medium load state or low load state.

In certain embodiments, said selecting step may include receiving a switching control signal for operating a switch unit connected in parallel to the alternating current capacitor, and performing the on/off operation of the switch unit based on the switching control signal to perform the first mode or the second mode.

Accordingly, in a compressor control apparatus and method as embodied and broadly described herein, an alternating current capacitor may be selectively used to apply a suitable size of voltage to the compressor motor based on the state of the load, thereby obtaining an effect of enhancing the drive efficiency of the compressor.

Furthermore, in a compressor control apparatus and method as embodied and broadly described herein, the compressor may be operated in an operation mode in which commercial power applied to the compressor does not pass through an alternating current capacitor when the load is in an overload state, thereby obtaining an effect of preventing the loss of a drive and effectively reducing the copper and core loss of the compressor.

Moreover, in a compressor control apparatus and method as embodied and broadly described herein, overall consumption may be reduced due to the loss reduction of a drive, thereby obtaining an effect of improving the energy efficiency, and reducing the harmonic components for generating the same stroke even when an alternating current (AC) capacitor is provided therein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor control apparatus, comprising:

an alternating current (AC) capacitor configured to be connected in series to a compressor, the compressor being configured to receive commercial power;

a microcomputer configured to generate a control signal for selectively operating in a first mode in which power applied to the compressor passes through the alternating current capacitor and a second mode in which power applied to the compressor passes through a branched circuit, based on a load state of the compressor; and a switch configured to control the commercial power applied to the alternating current capacitor in response to the control signal generated by the microcomputer, wherein the switch includes a first alternating current switch and a second alternating current switch, wherein the first alternating current switch is connected in series with the alternating current capacitor, wherein the second alternating current switch is not connected in series with the alternating current capacitor, wherein the microcomputer generates a first control signal for operation in the first mode when the load state is an overload state and generates a second control signal for operation in the second mode when the load state is a medium load state or a low load state, wherein the first mode includes operating the first alternating current switch to allow the power applied to the compressor to pass through the alternating current capacitor, and wherein the second mode includes operating the second alternating current switch to allow the power applied to the compressor to not pass through the alternating current capacitor.

2. The compressor control apparatus of claim 1, wherein an initial state of a switching element provided in the switch is an ON state.

3. The compressor control apparatus of claim 1, further including:

a load detector configured to detect the load state and provide the detected load state to the microcomputer.

4. The compressor control apparatus of claim 3, wherein the microcomputer includes an overload determination device configured to determine whether the detected load state is the overload state.

5. The compressor control apparatus of claim 1, wherein, while a motor of the compressor is operating, the microcomputer generates the first control signal for operation in the first mode and operates the first alternating current switch connected in series to the alternating current capacitor when the load state is the overload state.

6. The compressor control apparatus of claim 1, wherein, while a motor of the compressor is operating, the microcomputer generates the second control signal for operation in the second mode and operates the second alternating current switch not connected to the alternating current capacitor when the load state is the medium load state or the low load state.

7. The compressor control apparatus of claim 1, wherein the second alternating current switch not connected to the alternating current capacitor is not connected in series to the alternating current capacitor in the second mode.

8. The compressor control apparatus of claim 1, wherein the second alternating current switch not connected to the alternating current capacitor is not connected in series to the alternating current capacitor while a motor of the compressor is operating.

9. The compressor control apparatus of claim 1, wherein the first mode further includes turning off the second alternating current switch to prevent the power applied to the compressor from passing through the branch circuit, and wherein the second mode further includes turning off the first alternating current switch to prevent the power applied to the compressor from passing through the alternating current capacitor.

10. A compressor control apparatus, comprising:

an alternating current (AC) capacitor configured to be connected in series to a compressor;

a switch including a first alternating current switch and a second alternating current switch, wherein the first alternating current switch is connected in series to the alternating current capacitor, and wherein the second alternating current switch is not connected in series to the alternating current capacitor, a microcomputer configured to selectively operate in a first mode in which power applied to the compressor passes through the alternating current capacitor, and a second mode in which commercial power does not pass through the alternating current capacitor, based on a load state, wherein the microcomputer generates a first control signal for operation in the first mode when the load state is an overload state and generates a second control signal for operation in the second mode when the load state is a medium load state or a low load state, wherein the first mode includes operating the first alternating current switch to cause the power applied to the compressor to pass through the alternating current capacitor, and wherein the second mode includes operating the second alternating current switch to cause the power applied to the compressor to not pass through the alternating current capacitor.

11. The compressor control apparatus of claim 10, wherein the first mode further includes turning off the second alternating current switch to prevent the power applied to the compressor from passing through the branch circuit, and wherein the second mode further includes turning off the first alternating current switch to prevent the power applied to the compressor from passing through the alternating current capacitor.

12. A compressor control apparatus, comprising:

an alternating current (AC) capacitor configured to be connected in series to a compressor;

a switch including a first alternating current switch and a second alternating current switch, wherein the first alternating current switch is connected in series to the alternating current capacitor, and wherein the second alternating current switch is not connected in series to the alternating current capacitor; and a microcomputer configured to selectively operate in a first mode in which commercial power applied to the compressor passes through the alternating current capacitor, and a second mode in which the commercial power passes through a branched circuit, based on a load state, wherein the microcomputer generates a first control signal for operation in the first mode when die load state is an overload state and generates a second control signal for operation in the second mode when the load state is a medium load state or a low load state, wherein the first mode includes operating the first alternating current switch to allow the power applied to the compressor to pass through the alternating current capacitor, and wherein the second mode includes operating the second alternating current switch to allow the power applied to the compressor to not pass through the alternating current capacitor.

13. The compressor control apparatus of claim 12, wherein the wherein the first mode further includes turning off the second alternating current switch to prevent the power applied to the compressor from passing through the branch circuit, and wherein the second mode further includes turning off the first alternating current switch to prevent the power applied to the compressor from passing through the alternating current capacitor.

14. A compressor control method in which an alternating current capacitor is connected in series to a compressor, the method comprising:

determining a load state of the compressor; and selecting, based on the determined load state, one of a first mode that allows power applied to the compressor to pass through the alternating current capacitor or a second mode that allows power applied to the compressor to pass through a branched circuit, wherein the compressor includes a first alternator current switch and a second alternating current switch, wherein the first alternating current switch is connected in series to the alternating current capacitor, and wherein the second alternating current switch is not connected in series to the alternating current capacitor, wherein the first mode includes operating the first alternating current switch to allow the power applied to the compressor to pass through the alternating current capacitor, and wherein the second mode includes operating the second alternating current switch to allow the power applied to the compressor to not pass through the alternating current capacitor, and wherein selecting one of the first mode or the second mode includes selecting the second mode when the load state is a medium load state or a low load state.

15. The method of claim 14, wherein selecting one of the first mode or the second mode includes selecting the first mode when the load state is an overload state.

16. The method of claim 14, wherein said selecting one of a first mode or a second mode includes:

receiving a switching control signal for operating a switch connected in parallel to the alternating current capacitor; and performing an on/off operation of the switch in response to the received switching control signal and performing the first mode or the second mode.

17. The method of claim 14, wherein the first mode further includes turning off the second alternating current switch to prevent the power applied to the compressor from passing through the branch circuit, and wherein the second mode further includes turning off the first alternating current switch to prevent the power applied to the compressor from passing through the alternating current capacitor.

* * * * *